US010260502B2

(12) United States Patent
Müller et al.

(10) Patent No.: US 10,260,502 B2
(45) Date of Patent: Apr. 16, 2019

(54) PUMPING METHOD IN A SYSTEM OF VACUUM PUMPS AND SYSTEM OF VACUUM PUMPS

(71) Applicant: Ateliers Busch SA, Chevenez (CH)

(72) Inventors: Didier Müller, Delémont (CH); Jean-Eric Larcher, Delle (FR); Théodore Iltchev, Grandvillars (FR)

(73) Assignee: Ateliers Busch SA, Chevenez (CH)

( * ) Notice: Subject to any disclaimer, the term of this patent is extended or adjusted under 35 U.S.C. 154(b) by 111 days.

(21) Appl. No.: 15/126,875

(22) PCT Filed: Apr. 7, 2014

(86) PCT No.: PCT/EP2014/056938
§ 371 (c)(1),
(2) Date: Sep. 16, 2016

(87) PCT Pub. No.: WO2015/144254
PCT Pub. Date: Oct. 1, 2015

(65) Prior Publication Data

US 2017/0089339 A1 Mar. 30, 2017

(51) Int. Cl.
*F03C 2/00* (2006.01)
*F03C 4/00* (2006.01)
(Continued)

(52) U.S. Cl.
CPC ..... *F04C 25/02* (2013.01); *F04C 18/16* (2013.01); *F04C 23/005* (2013.01); *F04C 28/06* (2013.01);
(Continued)

(58) Field of Classification Search
CPC ..... F04C 18/16; F04C 23/005; F04C 25/02; F04C 28/06; F04C 28/065;
(Continued)

(56) References Cited

U.S. PATENT DOCUMENTS 3,536,418 A * 10/1970 Breaux ..... F04D 19/046 415/100
2002/0131870 A1* 9/2002 Puech ..... F04B 37/14 417/205
(Continued)

FOREIGN PATENT DOCUMENTS

JP 2007100562 A 4/2007
WO 03/093678 A1 11/2003
(Continued)

OTHER PUBLICATIONS

International Search Report for PCT/EP2014/056938 dated Nov. 17, 2014, 12 pgs.

*Primary Examiner* — Theresa Trieu
(74) *Attorney, Agent, or Firm* — Abel Schillinger, LLP

(57) ABSTRACT

The present invention relates to a pumping method in a pumping system (SP) comprising: a primary dry screw-type vacuum pump (3) with a gas entry orifice (2) connected to a vacuum chamber (1) and a gas exit orifice (4) leading into a conduit (5) before coming out into the gas outlet (8) of the pumping system (SP), a non-return valve (6) positioned in the conduit (5) between the gas exit orifice (4) and the gas outlet (8), and an ejector (7) connected in parallel to the non-return valve (6). According to this method, the primary dry screw-type vacuum pump (3) is put into operation in order to pump the gases contained in the vacuum chamber (1) through the gas exit orifice (4); in a simultaneous way, the ejector (7) is fed with working fluid, and the ejector (7) continues to be fed with working fluid all the time that the primary dry screw-type vacuum pump (3) pumps the gases contained in the vacuum chamber (1) and/or all the time that the primary dry screw-type vacuum pump (3) maintains a defined pressure in the vacuum chamber (1). The present
(Continued)

invention also relates to a pumping system (SP) able to be used for implementing this method.

22 Claims, 2 Drawing Sheets

(51) Int. Cl.

| | |
|---|---|
| ***F04C 2/00*** | (2006.01) |
| ***F04C 25/02*** | (2006.01) |
| ***F04C 23/00*** | (2006.01) |
| ***F04C 28/06*** | (2006.01) |
| ***F04C 18/16*** | (2006.01) |
| ***F04F 5/20*** | (2006.01) |
| ***F04F 5/54*** | (2006.01) |
| ***F04F 5/52*** | (2006.01) |

(52) U.S. Cl.
CPC ..... *F04C 28/065* (2013.01); *F04F 5/20* (2013.01); *F04F 5/52* (2013.01); *F04F 5/54* (2013.01); *F04C 2210/221* (2013.01); *F04C 2210/225* (2013.01); *F04C 2220/12* (2013.01); *F04C 2220/30* (2013.01)

(58) Field of Classification Search
CPC ..... F04C 2210/221; F04C 2210/225; F04C 2220/12; F04C 2220/30; F04F 5/20; F04F 5/52; F04F 5/54
USPC ..... 418/1, 201.1, 270, 5, 9
See application file for complete search history.

(56) References Cited

U.S. PATENT DOCUMENTS

| | | | | |
|---|---|---|---|---|
| 2005/0232783 | A1* | 10/2005 | Tell | F04B 23/04 417/85 |
| 2012/0219443 | A1* | 8/2012 | Neel | F04C 23/005 418/1 |
| 2017/0045051 | A1* | 2/2017 | Muller | F04C 23/005 |
| 2017/0284394 | A1* | 10/2017 | Muller | F04C 25/02 |

FOREIGN PATENT DOCUMENTS

| | | | |
|---|---|---|---|
| WO | 2011061429 | A2 | 5/2011 |
| WO | 2014012896 | A2 | 1/2014 |

* cited by examiner

PUMPING METHOD IN A SYSTEM OF VACUUM PUMPS AND SYSTEM OF VACUUM PUMPS

TECHNICAL FIELD OF THE INVENTION

The present invention relates to a pumping method enabling the performance to be improved in terms of flow rate and final vacuum in a system of vacuum pumps in which the main pump is a dry vacuum pump of screw type, and this while reducing the temperature of the exit gases and the system's consumption of electric energy. The present invention also relates to a system of vacuum pumps which can be used to achieve the method according to the present invention.

PRIOR ART

The general tendencies to increase the performance of vacuum pumps, to reduce the costs of installations and of the consumption of energy in industries such as the chemical industry, the pharmaceutical industry, vacuum deposition, semi-conductors, etc. have brought significant developments in terms of performance, energy saving, bulk, in the drives, etc.

The state of the art shows that to improve the final vacuum it must add supplementary stages in the vacuum pumps of the multi-staged Roots type or multi-staged claw type. For dry vacuum pumps of the screw type supplementary turns must be given to the screw and/or the rate of internal compression must be increased.

The speed of rotation of the pump plays a very important role which defines the operation of the pump in the different phases of evacuation of the chambers. With the rates of internal compression of the pumps available on the market (the range of which is, for example, between 2 and 20), the electric power required in the phases of pumping at suction pressure between atmospheric pressure and about 100 mbar or otherwise called strong mass flow rate would be very high. The commonplace solution is to use a variable speed drive which allows the reduction or the increase of the speed and consequently of the capacity as a function of different criteria of pressure type, maximal flow, limit torque, temperature, etc. But during the periods of operation at reduced rotational speed there are drops in flow rate at high pressure, the flow rate being proportional to the speed of rotation. The variation in speed by variable frequency drive imposes a supplementary cost and bulkiness. Another commonplace solution is the use of valves of by-pass type at certain stages in the multi-staged vacuum pumps of Roots or claw type, or respectively at certain well defined positions along the screw in the dry vacuum pumps of screw type. This solution requires numerous parts and presents problems of reliability.

The state of the art concerning vacuum pump systems aiming at an improvement of the final vacuum and the increase of the flow rate show booster pumps of Roots type arranged upstream from primary dry pumps. This type of systems is bulky, and operates either with by-pass valves presenting problems of reliability or by employing means of measurement, checking, adjustment or automatic control. However, these means of checking, adjustment or automatic control must be pilot operated in an active way, which necessarily results in an increase in the number of components of the system, in its complexity and in its cost.

SUMMARY OF INVENTION

The present invention has as its object to propose a pumping method in a system of vacuum pumps making it possible to obtain a better vacuum than that which can be obtained with the aid of a single dry vacuum pump of screw type (on the order of 0.0001 mbar) in a vacuum chamber.

The present invention also has as object to propose a pumping method in a system of vacuum pumps enabling a greater flow rate to be obtained at low pressure than that which can be obtained with the aid of a single dry vacuum pump of screw type during the pumping of a vacuum chamber.

The present invention likewise has as object to propose a pumping method in a system of vacuum pumps enabling reduction of the electric energy necessary for placing a vacuum chamber under vacuum and maintaining it as well as enabling the decrease in the temperature of the exit gases.

These objects of the present invention are attained with the aid of a pumping method which is achieved within the framework of a pumping system, the configuration of which consists essentially in a primary dry screw-type vacuum pump equipped with a gas entry orifice connected to a vacuum chamber and a gas exit orifice leading into a conduit which is equipped with a non-return valve before coming out into the atmosphere or into other apparatus. The suction port of an ejector is connected in parallel to this non-return valve, its outlet going to the atmosphere or rejoining the conduit of the primary pump after the non-return valve.

Such a pumping method is in particular the subject matter of the independent claim 1. Different preferred embodiments of the invention are moreover the subject matter of the dependent claims.

The method consists essentially in feeding the ejector with working fluid and making it operate continuously all the time that the primary dry screw-type vacuum pump pumps the gases contained in the vacuum chamber through the gas inlet orifice, but also all the time that the primary dry screw-type vacuum pump maintains a defined pressure (for example the final vacuum) in the chamber by releasing the rising gases through its outlet.

According to a first aspect, the invention resides in the fact that the coupling of the primary dry screw-type vacuum pump and of the ejector do not require specific measurements and apparatus (for example sensors for pressure, temperature, current, etc.), automatic controls or the management of data and calculation. Consequently the system of vacuum pumps adapted for implementing the pumping method according to the present invention comprises a minimal number of components, has great simplicity and costs considerably less with respect to existing systems.

According to a second aspect, the invention resides in the fact that, thanks to a new pumping method, the primary dry screw-type vacuum pump can operate at a single constant speed, that of the electrical grid, or turn at variable speeds according to its own mode of operation. Consequently, the complexity and the cost of the system of vacuum pumps adapted for implementing the pumping method according to the present invention can be further reduced.

By its nature, the ejector integrated in the system of vacuum pumps can always function without damage according to this pumping method. Its dimensioning depends upon a minimal consumption of working fluid for the operation of the device. It is normally single-staged. Its nominal flow rate is selected as a function of the enclosed space of the exit conduit of the primary dry screw-type vacuum pump limited by the non-return valve. Its flow can be 1/500 to 1/20 of the nominal flow rate of the primary dry screw-type vacuum pump, but it can also be less or more than these values. The working fluid for the ejector can be compressed air, but also other gases, for example nitrogen. The non-return valve placed in the conduit at the exit of the primary dry screw-type vacuum pump can be a commercially available standard element. It is dimensioned according to the nominal flow rate of the primary dry screw-type vacuum pump. In particular, it is foreseen that the non-return valve closes when the pressure at the suction end of the primary dry screw-type vacuum pump is between 500 mbar absolute and the final vacuum (for example 100 mbar).

According to another variant, the ejector is multi-staged.

According to still another variant, the ejector can be made of material having increased chemical resistance to substances and gases commonly used in the semi-conductor industry, this in the mono-staged ejector variant as well as in the multi-staged ejector.

The ejector is preferably of small size.

According to another variant, the ejector is integrated in a cartridge which incorporates the non-return valve.

According to still another variant, the ejector is integrated in a cartridge which incorporates the non-return valve and this cartridge itself is accommodated in an exhaust muffler fixed to the gas exit orifice of the primary dry screw-type vacuum pump.

According to the operation of the system of vacuum pumps according to the invention, the ejector always pumps in the enclosed space between the gas exit orifice of the primary dry screw-type vacuum pump and the non-return valve.

According to still another variant of the present invention, the flow rate of gas at the pressure necessary for operation of the ejector is provided by a compressor. In a noteworthy way, this compressor can be driven by at least one of the shafts of the primary dry screw-type pump or, alternatively or additionally, can be driven in an autonomous manner, independently of the primary dry screw-type pump. This compressor can evacuate the atmospheric air or gases in the gas exit conduit after the non-return valve. The presence of such a compressor renders the system of screw pumps independent of a source of compressed gas, which can be suitable for certain industrial environments.

Starting from a cycle of evacuation of the chamber, the pressure there is increased, for example to equal the atmospheric pressure. In view of the compression in the primary dry screw-type vacuum pump, the pressure of the gases released at its exit is higher than the atmospheric pressure (if the gases at the outlet of the primary pump are released directly into the atmosphere) or higher than the pressure at the inlet of another apparatus connected downstream. This causes the opening of the non-return valve.

When this non-return valve is open, the action of the ejector is felt very slightly since the pressure at its inlet is almost equal to that of its outlet. In contrast, when the non-return valve closes at a certain pressure (since the pressure in the chamber has dropped in the meantime), the action of the ejector causes a progressive reduction of the difference in pressure between the chamber and the conduit after the valve. The pressure at the exit of the primary dry screw-type vacuum pump becomes that of the inlet of the ejector, that of its outlet always being the pressure in the conduit after the non-return valve. The more the ejector pumps, the more the pressure reduces at the outlet of the primary dry screw-type vacuum pump, in the enclosed space limited by the closed non-return valve, and consequently the pressure difference decreases between the chamber and the outlet of the primary dry screw-type vacuum pump. This slight difference reduces the internal leaks in the primary dry screw-type vacuum pump and brings about a lowering of the pressure in the chamber which improves the final vacuum. Moreover the primary dry screw-type vacuum pump consumes less and less energy for the compression and produces less and less heat of compression.

On the other hand, it is also evident that the study of the mechanical concept aims to reduce the enclosed space between the gas exit orifice of the primary dry screw-type vacuum pump and the non-return valve with the aim of lowering the pressure there more quickly.

BRIEF DESCRIPTION OF DRAWINGS

The particularities and the advantages of the present invention will become evident with more details within the context of the description which follows with embodiment examples given by way of illustration and in a non-limiting way with reference to the attached drawings which represent.

DETAILED DESCRIPTION OF EMBODIMENTS OF THE INVENTION

Figure 1:
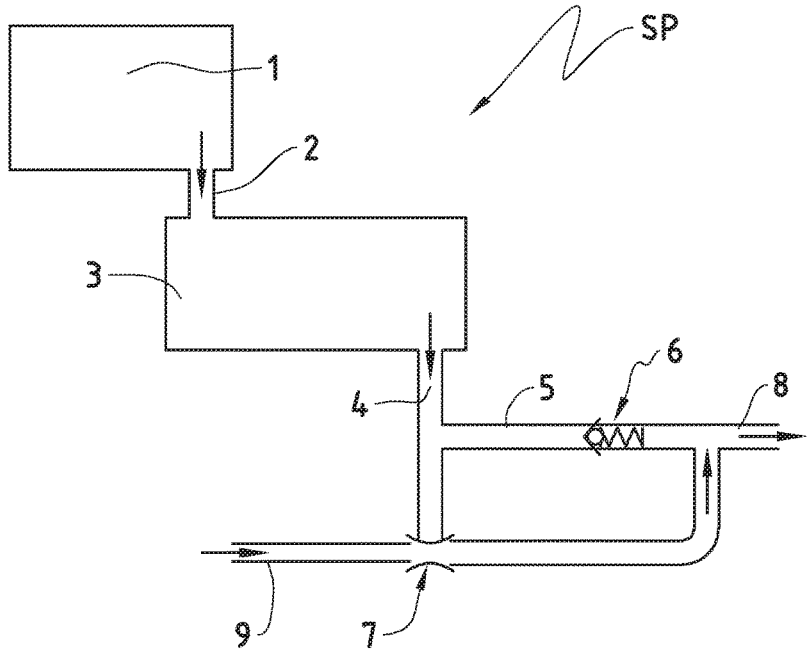
FIG. 1 represents diagrammatically a system of vacuum pumps adapted to achieve a pumping method according to a first embodiment of the present invention.

FIG. 1 represents a system of vacuum pumps SP adapted to implement a pumping method according to a first embodiment of the present invention.

This system of vacuum pumps SP comprises a chamber 1, which is connected to a suction orifice or intake 2 of a primary dry screw-type vacuum pump 3. The gas exit orifice of the primary dry screw-type vacuum pump 3 is connected to the conduit 5. A non-return release valve 6 is placed in the conduit 5, which, after this non-return valve, continues into the gas exit conduit 8. The non-return valve 6, when it is closed, permits the formation of an enclosed space 4, contained between the gas exit orifice of the primary vacuum pump 3 and the valve itself. The system of vacuum pumps SP also comprises an ejector 7, connected in parallel to the non-return valve 6. The intake of the ejector is connected to the enclosed space 4 of the conduit 5 and its release orifice is connected to the conduit 8. The feed pipe 9 provides the working fluid for the ejector 7.

With the setting in operation of the primary dry screw-type vacuum pump 3, the working fluid for the ejector 7 is injected by the feed pipe 9. The primary dry screw-type vacuum pump 3 suctions the gases in the chamber 1 through the connected conduit 2 at its inlet and compresses them in order to release them afterwards at its exit in the conduit 5 through the non-return valve 6. When the pressure for closure of the non-return valve 6 is reached, the valve closes. Starting from this moment the pumping of the ejector 7 progressively reduces the pressure in the enclosed space 4 to the value of its pressure limit. In parallel the power consumed by the primary dry screw-type vacuum pump 3 drops progressively. This takes place in a short period of time, for example for a certain cycle in 5 to 10 seconds.

With a suitable adjustment of the flow rate of the ejector 7 and of the closure pressure of the non-return valve 6 as a function of the flow rate of the primary dry screw-type vacuum pump 3 and the enclosed space of the chamber 1, it is moreover possible to reduce the time before the closure of the non-return valve 6 in relation to the duration of the cycle of evacuation and thus reduce the losses in working fluid during this time of operation of the ejector 7 without effect on the pumping. Furthermore, these "losses", which are minute, are taken into account in the evaluation of the total amount of energy consumption. In contrast, the advantage of the simplicity results in an excellent reliability for the system as well as a 10% to 20% lower price compared with similar pumps equipped with programmable automatic devices and/or with variable speed drive units, control valves, sensors, etc.

Figure 2:
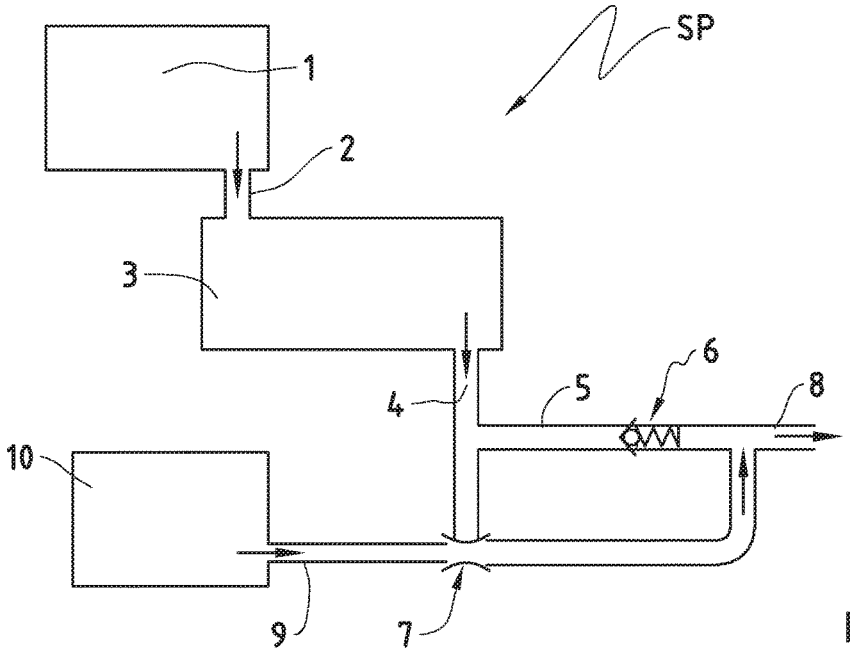
FIG. 2 represents diagrammatically a system of vacuum pumps adapted to achieve a pumping method according to a second embodiment of the present invention.

FIG. 2 represents a system of vacuum pumps SP adapted for implementing a pumping method according to a second embodiment of the present invention.

With respect to the system represented in FIG. 1, the system represented in FIG. 2 further comprises a compressor 10 which provides the gas flow rate at the pressure necessary for the functioning of the ejector 7. In effect, this compressor 10 can suction the atmospheric air or gases in the gas exit conduit 8 after the non-return valve 6. Its presence makes the system of vacuum pumps independent of a compressed gas source, which can be suitable for certain industrial environments. The compressor 10 can be driven by at least one shaft of the primary dry screw-type pump 3 or by its own electric motor, thus in a way completely independent of the pump 3. In all cases its consumption of energy to enable it to provide the gas flow rate at the pressure necessary in order to make the ejector 7 operate is by far much smaller (for example on the order of 3% to 5%) in relation to the savings achieved in energy consumption of the main pump 3.

Figure 3:
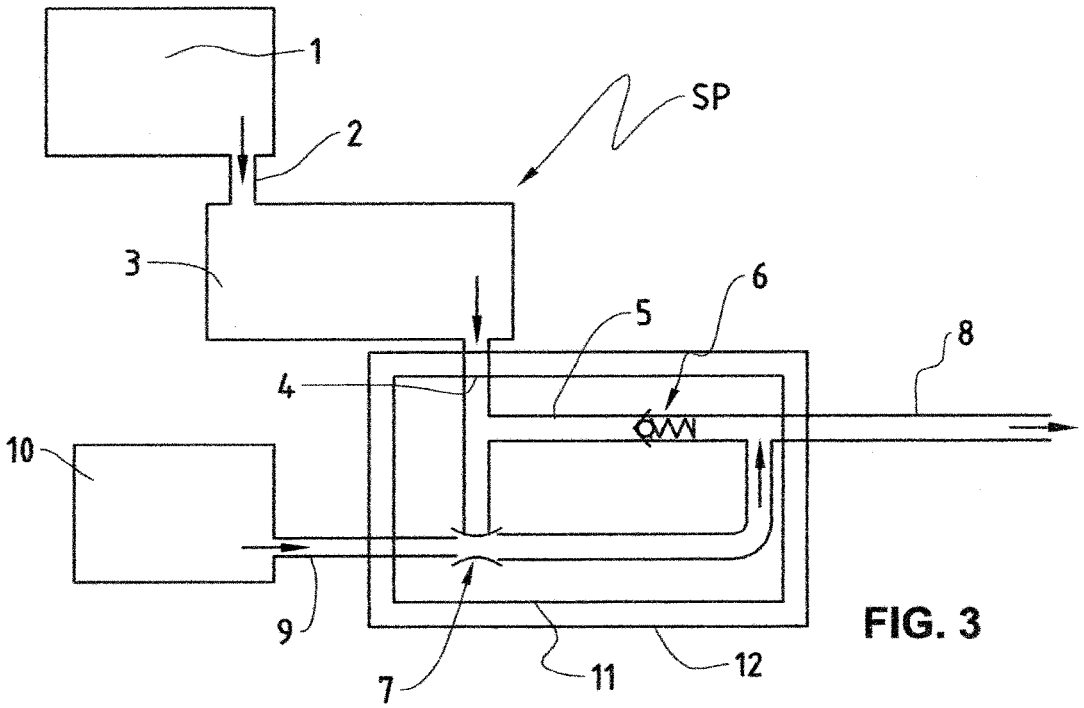
FIG. 3 represents diagrammatically a system of vacuum pumps adapted to achieve a pumping method according to a third embodiment of the present invention.

FIG. 3 represents a system of vacuum pumps SP adapted for implementing a pumping method according to a third embodiment of the present invention. For efficient maintenance, the ejector 7 is integrated in a cartridge 12 which incorporates the non-return valve 6. In addition, the cartridge 12 may be accommodated in an exhaust muffler fixed to the gas exit orifice (5) of the primary dry screw-type vacuum pump (3).

Figure 4:
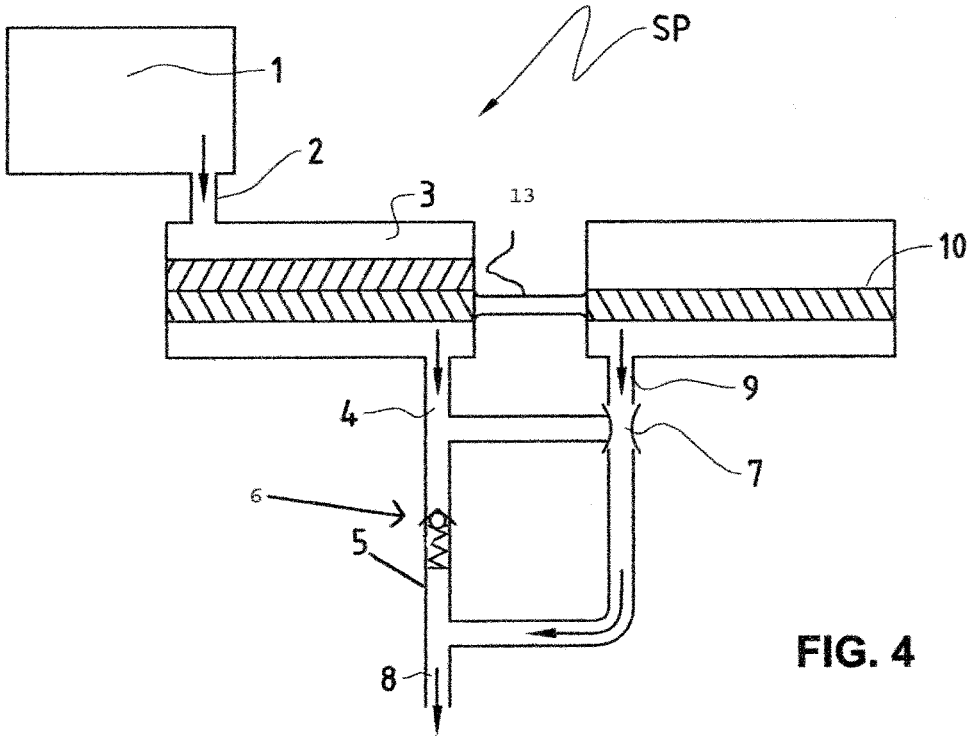
FIG. 4 represents diagrammatically a system of vacuum pumps adapted to achieve a pumping method according to a fourth embodiment of the present invention.

FIG. 4 represents a system of vacuum pumps SP for implementing a pumping method according to a fourth embodiment of the present invention. To reduce consumption of electrical power by the pumping system, the compressor (10) is driven by a shaft (13) of the primary dry screw-type pump (3).

Of course the present invention is subject to numerous variations as regards its implementation. Although diverse embodiments have been described, it is well understood that it is not conceivable to identify all the possible embodiments in an exhaustive way. It can of course be envisaged to replace one means described with an equivalent means without departing from the scope of the present invention. All these modifications form part of the common knowledge of one skilled in the art in the field of vacuum technology.

The invention claimed is:

1. Pumping method in a system of vacuum pumps comprising:

providing a system of vacuum pumps comprising a primary dry screw-type vacuum pump with a gas entry orifice connected to a vacuum chamber and a gas exit orifice leading into a conduit before coming out into a gas outlet of the system of vacuum pumps, a non-return valve positioned in said conduit between the gas exit orifice and the gas outlet, an ejector connected in parallel to said non-return valve, and a compressor driven by at least one shaft of said primary dry screw-type vacuum pump, wherein said primary dry screw-type vacuum pump is put in operation in order to pump gases contained in said vacuum chamber through the gas exit orifice;

in a simultaneous way, said ejector is fed with working fluid by said compressor; and said ejector continues to be fed with said working fluid in at least one of the following conditions: all the time that said primary dry screw-type vacuum pump pumps the gases contained in said vacuum chamber and all the time that said primary dry screw-type vacuum pump maintains a defined pressure in said vacuum chamber.

2. The pumping method according to claim 1, wherein said ejector includes an outlet that rejoins said conduit after said non-return valve.

3. The pumping method according to claim 1, wherein said ejector is dimensioned in order to have a minimal consumption of working fluid.

4. The pumping method according to claim 1, wherein a nominal flow rate of said ejector is selected as a function of an enclosed space of said conduit of said primary dry screw-type vacuum pump which is limited by said non-return valve.

5. The pumping method according to claim 4, wherein said ejector has a flow rate that is from 1/500 to 1/20 of the nominal flow rate of said primary dry screw-type vacuum pump.

6. The pumping method according to claim 1, wherein the working fluid of said ejector is at least one of compressed air and nitrogen.

7. The pumping method according to claim 1, wherein said ejector is single-staged or multi-staged.

8. The pumping method according to claim 1, wherein said non-return valve closes when pressure at a suction end of said primary dry screw-type vacuum pump is between 500 mbar absolute and a final vacuum.

9. The pumping method according to claim 1, wherein said ejector is made of a material having increased chemical resistance to substances and gases commonly used in the semi-conductor industry.

10. The pumping method according to claim 1, wherein said ejector is integrated in a cartridge which incorporates said non-return valve.

11. The pumping method according to claim 10, wherein said cartridge is accommodated in an exhaust muffler fixed to the gas exit orifice of said primary dry screw-type vacuum pump.

12. A system of vacuum pumps comprising:

a primary dry screw-type vacuum pump with a gas entry orifice connected to a vacuum chamber and a gas exit orifice leading into a conduit before coming out into a gas outlet of the system of vacuum pumps, a non-return valve positioned in said conduit between the gas exit orifice and the gas outlet, an ejector connected in parallel to said non-return valve, and a compressor driven by at least one shaft of said primary dry screw-type vacuum pump, wherein said ejector is adapted to be fed with working fluid in at least one of the following conditions: all the time that said primary dry screw-type vacuum pump pumps gases contained in said vacuum chamber and all the time that said primary dry screw-type vacuum pump maintains a defined pressure in said vacuum chamber.

13. The system of vacuum pumps according to claim 12, wherein said ejector includes an outlet that rejoins said conduit after said non-return valve.

14. The system of vacuum pumps according to claim 12, wherein said ejector is dimensioned in order to have a minimal consumption of working fluid.

15. The system of vacuum pumps according to claim 12, wherein a nominal flow rate of said ejector is selected as a function of an enclosed space of said conduit of said primary dry screw-type vacuum pump which is limited by said non-return valve.

16. The system of vacuum pumps according to claim 15, wherein said ejector has a flow rate that is from 1/500 to 1/20 of the nominal flow rate of said primary dry screw-type vacuum pump.

17. The system of vacuum pumps according to claim 12, wherein the working fluid of said ejector is at least one of compressed air and nitrogen.

18. The system of vacuum pumps according to claim 12, wherein said ejector is single-staged or multi-staged.

19. The system of vacuum pumps according to claim 12, wherein said non-return valve closes when the pressure at a suction end of said primary dry screw-type vacuum pump is between 500 mbar absolute and a final vacuum.

20. The system of vacuum pumps according to claim 12, wherein said ejector is made of a material having increased chemical resistance to substances and gases commonly used in the semi-conductor industry.

21. The system of vacuum pumps according to claim 12, wherein said ejector is integrated in a cartridge which incorporates said non-return valve.

22. The system of vacuum pumps according to claim 21, wherein said cartridge is accommodated in an exhaust muffler fixed to the gas exit orifice of said primary dry screw-type vacuum pump.

* * * * *